US010694844B1

(12) United States Patent
Smed

(10) Patent No.: US 10,694,844 B1
(45) Date of Patent: Jun. 30, 2020

(54) WINE CAROUSEL

(71) Applicant: Ole Falk Smed, Calgary (CA)

(72) Inventor: Ole Falk Smed, Calgary (CA)

( * ) Notice: Subject to any disclaimer, the term of this patent is extended or adjusted under 35 U.S.C. 154(b) by 0 days.

(21) Appl. No.: 16/514,731

(22) Filed: Jul. 17, 2019

Related U.S. Application Data

(60) Provisional application No. 62/700,091, filed on Jul. 18, 2018.

(51) Int. Cl.

| | |
|---|---|
| ***A47B 73/00*** | (2006.01) |
| ***A47B 49/00*** | (2006.01) |
| ***A47F 5/00*** | (2006.01) |
| ***A47F 5/01*** | (2006.01) |
| ***A47B 96/14*** | (2006.01) |
| ***A47F 5/02*** | (2006.01) |
| ***A47F 5/04*** | (2006.01) |

(52) U.S. Cl.
CPC ..... *A47B 73/002* (2013.01); *A47B 49/004* (2013.01); *A47B 73/008* (2013.01); *A47B 96/1425* (2013.01); *A47F 5/0031* (2013.01); *A47F 5/0037* (2013.01); *A47F 5/01* (2013.01); *A47F 5/02* (2013.01); *A47F 5/04* (2013.01)

(58) Field of Classification Search
CPC ..... A47B 73/002; A47B 49/004; A47B 55/02; A47B 73/00; A47B 73/008; A47B 87/001; A47B 49/00; A47B 96/1425; A47B 2063/005; A47B 96/14; A47B 96/1433; A47B 96/145; A47F 5/04; A47F 7/28; A47F 5/05; A47F 5/06; A47F 5/02; A47F 5/106; A47F 5/08; A47F 3/147; A47F 5/0031; A47F 5/0037; A47F 5/01; A47F 5/13
USPC ... 211/74, 77, 107, 110, 111, 112, 163, 165, 211/166, 196, 205, 133.4, 181.1, 133.5, 211/133.2, 133.1, 131.1, 129.1, 126.2, 211/126.9
See application file for complete search history.

(56) References Cited

U.S. PATENT DOCUMENTS 197,931 A * 12/1877 Haight ..... A47B 11/00 108/94
274,087 A * 3/1883 Danner ..... A47B 49/00 108/105
874,933 A * 12/1907 Bristow, Jr. ..... A47B 49/004 211/77

(Continued)

*Primary Examiner* — Jennifer E. Novosad
(74) *Attorney, Agent, or Firm* — Carl A. Hjort, III

(57) ABSTRACT

A wine carousel including top and bottom mounting brackets, each having a coupling with a flange, the flange having mounting holes for mounting the brackets and the coupling having a bushing retained therein; a plurality of central tube portions connected together to form a central tube extending from the coupling in the top mounting bracket to the coupling in the bottom mounting bracket, the central tube being rigidly attached to the top and bottom mounting brackets and non-rotatable with respect to the top and bottom mounting brackets; a plurality of circular carousel members having nests projecting from a central axis to position and hold wine bottles shoulder to shoulder, and having a carousel tube for receiving the central tube; and a plurality of glide blocks secured to the central tube portions and have bushings disposed therein, and wherein the circular carousel members sit on the glide blocks and are independently rotatable around the central tube portions.

6 Claims, 2 Drawing Sheets

(56) References Cited

U.S. PATENT DOCUMENTS 969,959 A * 9/1910 Knight ..... A47B 49/004 312/305
1,732,298 A * 10/1929 Arthur ..... A47G 23/08 312/35
1,735,051 A * 11/1929 Christ ..... A01J 11/00 211/129.1
2,025,416 A * 12/1935 Limerick, Jr. ..... A47B 49/004 312/305
2,244,950 A * 6/1941 Jones ..... A47B 49/004 312/305
2,289,212 A * 7/1942 Rinnela ..... A43D 117/00 211/131.1
2,371,917 A * 3/1945 Rosenberg ..... A47B 49/00 211/131.1
2,526,245 A * 10/1950 Lathrop ..... A47B 49/00 108/28
2,553,507 A * 5/1951 Rosenberg ..... A47F 5/02 211/131.1
2,903,227 A * 9/1959 De Kalb Key ..... A47F 5/06 248/200.1
2,941,669 A * 6/1960 Palay ..... A47F 5/025 211/1.55
2,946,456 A * 7/1960 Liguori ..... A47F 7/283 211/77
3,161,264 A * 12/1964 Isaacson ..... A47B 96/1425 52/301
3,266,634 A * 8/1966 Tintary ..... A47F 5/02 211/131.1
3,297,372 A * 1/1967 Brader ..... A47F 1/08 312/45
3,452,880 A * 7/1969 Kovacik ..... A47F 7/28 211/77
3,963,126 A * 6/1976 Taub ..... A47F 5/02 211/131.1
4,036,367 A * 7/1977 Stambaugh ..... A47F 5/02 211/37
4,216,867 A * 8/1980 Sturm ..... A47F 5/04 211/131.1
4,688,684 A * 8/1987 Young ..... A47F 7/281 108/106
4,736,856 A * 4/1988 Alneng ..... A47F 5/05 211/131.1
4,819,817 A * 4/1989 Mar ..... A47B 96/1425 211/196
4,946,048 A * 8/1990 Francois ..... A47F 5/06 211/131.1
5,050,746 A * 9/1991 Frankel ..... A47F 5/02 211/163
5,127,528 A * 7/1992 Cone ..... A47B 96/1425 211/163
5,277,488 A * 1/1994 Cleary ..... F25D 25/027 211/131.1
5,279,429 A * 1/1994 Sagel ..... A47B 49/006 211/131.1
5,312,003 A * 5/1994 Domenig ..... A47B 49/004 211/131.1
5,318,175 A * 6/1994 Stevens ..... A47G 25/0664 211/107
5,562,216 A * 10/1996 Falconio ..... A47F 7/06 211/131.1
5,839,586 A * 11/1998 Smith ..... A47F 5/04 211/163
5,984,114 A * 11/1999 Frankel ..... A47F 7/08 211/131.1
6,502,707 B1 * 1/2003 Sullivan ..... A47F 5/02 211/144
6,550,730 B1 * 4/2003 Hong ..... A47B 57/26 108/147.13
D527,205 S * 8/2006 Axhamre ..... D6/677.2
RE39,917 E * 11/2007 Domenig ..... 211/129.1
D627,611 S * 11/2010 Cash ..... D6/677.2
7,975,643 B1 * 7/2011 Johnson ..... A47G 19/30 118/13
8,210,373 B2 * 7/2012 Liao ..... A47F 5/02 211/131.1
8,459,474 B2 * 6/2013 Sagel ..... A47B 49/006 211/144
8,915,391 B2 * 12/2014 Radow ..... A47G 19/00 108/139
9,615,660 B2 * 4/2017 Hogeback ..... A47B 73/00
2004/0217239 A1 * 11/2004 Chuang ..... A47B 96/1425 248/125.8
2008/0308687 A1 * 12/2008 Terry ..... F16B 12/40 248/122.1
2009/0255883 A1 * 10/2009 Boyd ..... A47F 5/02 211/70
2014/0255091 A1 * 9/2014 Baek ..... F16B 12/40 403/345
2015/0233639 A1 * 8/2015 Mustari ..... A47F 5/02 211/101
2017/0055780 A1 * 3/2017 Jepson ..... A47K 3/281
2017/0095077 A1 * 4/2017 Villalobos ..... F21V 33/0024
2019/0174967 A1 * 6/2019 Worden, IV ..... F16B 7/149

* cited by examiner

WINE CAROUSEL

DETAILED DESCRIPTION OF THE DRAWINGS

Embodiments of a wine carousel are shown and described. The wine carousel includes top and bottom mounting brackets, the top mounting bracket adapted to attach to a surface overlying the carousel assembly and the bottom mounting bracket being adapted to attached to a surface underlying the carousel, wherein each of said mounting brackets comprises a coupling with a flange, the flange having mounting holes for mounting to the aforesaid surfaces and the coupling having a bushing retained therein; a plurality of central tube portions, said central tube portions being connected together to form a central tube extending from the coupling in the top mounting bracket to the coupling in the bottom mounting bracket, and wherein the central tube is rigidly attached to the top and bottom mounting brackets and does not rotate with respect to the top and bottom mounting brackets; a plurality of circular carousel members, each of the carousel members having a central axis and nests projecting from the central axis to position and hold wine bottles shoulder to shoulder, and having a carousel tube disposed on the central axis, wherein the central tube is positioned inside the carousel tube and along the central axis of the circular carousel members; and wherein a plurality of glide blocks are provided, corresponding to the number of circular carousel members, each of the glide blocks being secured to the central tube portions and have a bushing disposed therein, and wherein the circular carousel members sit on the glide block in contact with the bushing and are rotatable around the central tube and wherein each of the circular carousel members is independently rotatable.

Figure 1:
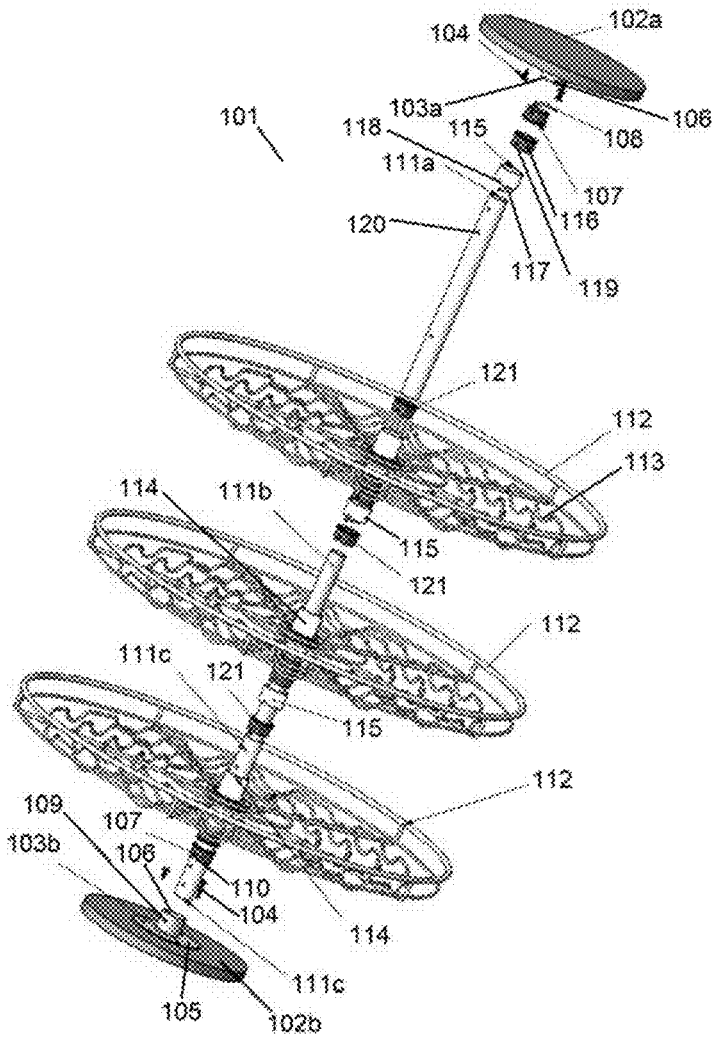
FIG. 1 is a partially-exploded view of an embodiment of the wine carousel.
Figure 2:
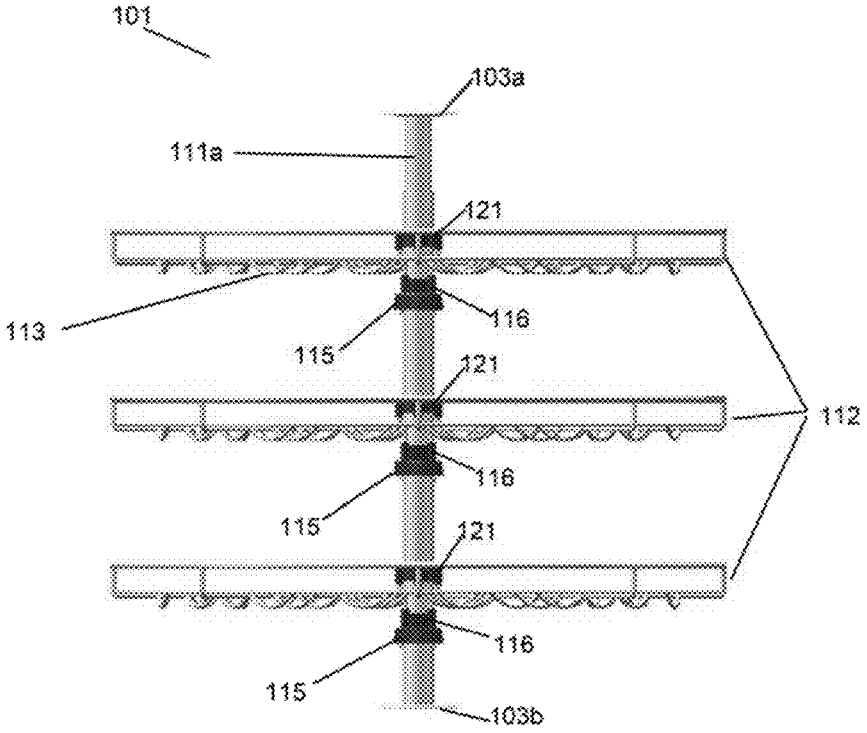
FIG. 2 is an assembled view of an embodiment of the wine carousel.

FIGS. 1 and 2 show a wine carousel 101. FIG. 1 is a partially exploded view, while FIG. 2 is an assembled view. The same numerals will be used to identify elements common to FIGS. 1 and 2. Thus, FIG. 1 shows the top 102*a* and bottom 102*b* surfaces that the wine carousel engages with. It should be appreciated, that only partial segments of the top and bottom surfaces 102*a* and 102*b* are shown in FIG. 1. By way of example and without limitation, the top and bottom surfaces 102*a* and 102*b* may be the upper and lower surfaces of the interior of a cabinet or some other enclosure in which the wine carousel 101 will be mounted. Attached to the top and bottom surfaces 102*a* and 102*b* are the top mounting bracket 103*a* and the bottom mounting bracket 103*b*. The top and bottom mounting brackets 103*a* and 103*b* may be secured to the top and bottom surfaces 102*a* and 102*b* by fasteners 104. One of ordinary skill in the art will readily appreciate that any suitable fasteners known in the art may be used to secure the respective mounting brackets to their respective surfaces. As shown in FIG. 1, screws are used as the fasteners 104, but the style or type of fastener may be dictated by the material which forms the top or bottom surface. The top and bottom surfaces may be made of the same or different materials and therefore, it may be necessary for different styles of fasteners to be used to mount the top and bottom mounting brackets to their respective surfaces.

The top mounting bracket 103*a* and bottom mounting bracket 103*b* are comprised of a flange 105 and a coupling 106. As discussed above, the flange 105 is provided with holes (not labelled) through which the fasteners 104 secure the respective mounting brackets to their respective surfaces. The coupling 106 is an annular hole into which a bushing 107 is received. The bushing 107 may be formed from any material known in the art, including, by way of example and without limitation, polypropylene. The bushing 107 is retained in the coupling 106 by a pin 108, which is inserted through a hole 109 in the side of coupling 106, into a through-hole 110 in the bushing 107 and further into a second hole (not shown) on the diametrically opposite side of the coupling 106. In this way, the bushing is retained in the coupling 106 and does not turn in the coupling 106.

Also shown in FIGS. 1 and 2 are the central tube portions 111*a-c*. The central tube portions 11*a-c* are connected together to form a central tube extending from the coupling 106 in the top mounting bracket 103*a* to the coupling 106 in the bottom mounting bracket 103*b*. One of ordinary skill in the art will readily appreciate that the central tube portions 111*a-c* can be connected and secured together by any means known in the art. By way example and without limitation, central tube portions 111*a-c* may connect together by means of a friction fit, or they may be held together by pins or fasteners extending through two adjacent, overlapped central tube portions. All that is required is the that the central tube portions 111*a-c*, when connected together, form a continuous, rigid tube extending between the top and bottom mounting brackets. It should further be appreciated that the central tube may be formed as a single tube or, as is shown in the drawings, as multiple tube portions joined together. One of ordinary skill in the art will appreciate that either approach could be used, depending on the constraints of any particular installation. For example, and without limitation, if the opening of an enclosure into which the wine carousel is to be placed is too small to accommodate a single, continuous central tube, the use of multiple tube segments assembled in place would be necessary. It should also be appreciated that the central tube, formed by the assembly of the central tube portions 111*a-c* is rigidly attached to the top and bottom mounting brackets 103*a* and 103*b* and does not rotate with respect to the top and bottom mounting brackets 103*a* and 103*b*. Instead, as will be discussed below, the rotation of the carousel assembles occurs around the fixed central tube, such that each of the carousel assemblies may independently rotate.

Referring again to FIGS. 1 and 2, a plurality of circular carousel members 112 are shown. While three (3) circular carousel members are shown in FIGS. 1 and 2, it should be appreciated that a greater number, or a lesser number, of circular carousel members could be implemented in the assembly, depending on the constraints of any particular installation. Each of the circular carousel members 112 has a central axis and nests 113 projecting from the central axis to position and hold wine bottles shoulder to shoulder. The circular carousel members may be formed from wire, bent to the appropriate shapes and welded together. Co-axial with the central axis of the circular carousel members 112 is a carousel tube 114. The carousel tube 114 is, for example, welded to the circular carousel members 112. The central tube 111 is positioned inside the carousel tube 114 and along the central axis of the circular carousel members 112. Thus, the central tube assembly, consisting of the central tube portions 111*a-c* acts as an axle and the carousel tubes 114 act as a hub on the axle, allowing for the rotation of the circular carousel members 112 about the central tube.

FIGS. 1 and 2 also show a plurality of glide blocks 115. The glide blocks 115 correspond to the number of circular carousel members 112. Additionally, a glide block 115 may be provided in contact with the top mounting bracket 103*a* to assist with the retention of the central tube portions 111*a-c* in the top mounting bracket 103*a*. Each of the glide blocks 115 are secured to the central tube portions 111*a-c* and have a bushing 116 disposed therein. The glide block 115 is secured to the central tube portions 111*a-c* and the bushing 116 is retained in the glide block by a pin 117, which is inserted through a hole 118 in the side of glide block 116, into a through-hole 119 in the bushing 116, Into a through hole 120 in the central tube portion (here 111*a*) and further into a second hole (not shown) on the diametrically opposite side of the glide block 115. In this way, the bushing 116 is retained in the glide block 115 and does not turn in the glide block, and the assembly of the glide block and bushing is further non-rotatably connected to the central tube portion. The bushing 116 may be made of any material known in the art, for example, polypropylene. It should be appreciated that the circular carousel members 112 sit on the glide blocks 115 in contact with the bushing 116 and are rotatable around the central tube portions 111*a-c*. In this way, since the central tube portions 111*a-c* are fixed and non-rotatable, each of the circular carousel members 112 is independently rotatable. Additionally, a top bushing 121 can be provided in the carousel tube 114 for each of the circular carousel members 112 to assist in the free rotation of the circular carousel member 112 about the central tube portions 111*a-c*.

It will be appreciated by those of ordinary skill in the art that, while the forgoing disclosure has been set forth in connection with particular embodiments and examples, the disclosure is not intended to be necessarily so limited, and that numerous other embodiments, examples, uses, modifications and departures from the embodiments, examples and uses described herein are intended to be encompassed by the claims attached hereto. Various features of the disclosure are set forth in the following claims.

The invention claimed is:

1. A wine carousel comprising:

top and bottom mounting brackets, the top mounting bracket adapted to attach to a surface overlying the carousel and the bottom mounting bracket being adapted to attach to a surface underlying the carousel, wherein each of said mounting brackets comprises a coupling with a flange, the flange having mounting holes for mounting to the aforesaid surfaces and the coupling having a bushing retained therein;

a plurality of central tube portions, said central tube portions being connected together to form a central tube extending from the coupling in the top mounting bracket to the coupling in the bottom mounting bracket, and wherein the central tube is rigidly attached to the top and bottom mounting brackets and does not rotate with respect to the top and bottom mounting brackets;

a plurality of circular carousel members, each of the carousel members having a central axis, nests projecting from the central axis, and a carousel tube disposed on the central axis, wherein the central tube is positioned inside the carousel tube and along the central axis of the circular carousel members; and wherein a plurality of glide blocks are provided, corresponding to the number of circular carousel members, each of the glide blocks being secured to the central tube portions and having a glide block bushing disposed therein, and wherein the circular carousel members sit on the glide block in contact with the glide block bushing and are rotatable around the central tube and wherein each of the circular carousel members is independently rotatable.

2. The carousel of claim 1, wherein the circular carousel members are formed of wire.

3. The carousel of claim 1, wherein the carousel tubes are welded to the circular carousel members.

4. The carousel of claim 1, wherein the bushings and the glide block bushings are formed from polypropylene.

5. The carousel of claim 1, wherein the bushings are retained in the top and bottom mounting brackets by a pin that extends through the coupling and through the bushing.

6. The carousel of claim 1, wherein the glide block bushings are retained in the glide blocks by a pin that extends through the glide block and through the bushing.

* * * * *